US006232851B1

(12) United States Patent
Huang

(10) Patent No.: US 6,232,851 B1
(45) Date of Patent: May 15, 2001

(54) COUPLING STRUCTURE FOR CAVITY RESONATORS

(75) Inventor: Guanghua Huang, Prior Lake, MN (US)

(73) Assignee: ADC Solitra, Inc.

( * ) Notice: Subject to any disclaimer, the term of this patent is extended or adjusted under 35 U.S.C. 154(b) by 0 days.

(21) Appl. No.: 09/247,380

(22) Filed: Feb. 10, 1999

(51) Int. Cl.[7] ..... H01P 1/20; H01P 7/04
(52) U.S. Cl. ..... 333/206; 333/202; 333/222
(58) Field of Search ..... 333/202, 206, 333/222, 207

(56) References Cited

U.S. PATENT DOCUMENTS

| | | | | |
|---|---|---|---|---|
| 3,008,103 | | 11/1961 | Maurer et al. | 333/202 |
| 4,280,113 | * | 7/1981 | Sekiguchi | 333/202 |
| 5,446,729 | * | 8/1995 | Jachowski | 333/203 |
| 5,684,438 | * | 11/1997 | Cavalieri D'Oro et al. | 333/202 |

FOREIGN PATENT DOCUMENTS

| | | |
|---|---|---|
| 273227 | 5/1951 | (CH) . |
| 56 834 | 7/1967 | (DD) . |
| 0 324 453 A2 | 7/1989 | (EP) . |
| 0 324 453 A3 | 7/1989 | (EP) . |
| 1 338 742 | 11/1973 | (GB) . |

* cited by examiner

*Primary Examiner*—Robert Pascal
*Assistant Examiner*—Patricia T. Nguyen
(74) *Attorney, Agent, or Firm*—Fogg Slifer & Polglaze, P.A.; David N. Fogg

(57) ABSTRACT

A resonator filter comprising a housing formed with a conductive material. The housing defines a first cavity, a second cavity, and an intermediate wall positioned between the first and second cavities. The housing defines an opening between the first and second cavities. First and second center conductors are positioned within the first and second cavities, respectively. A coupling wire is connected between the first center conductor and the housing. The coupling wire and the center conductor have substantially equal thermal expansion coefficients.

13 Claims, 3 Drawing Sheets

COUPLING STRUCTURE FOR CAVITY RESONATORS

TECHNICAL FIELD

The present invention relates to a structures for filters, and more particularly to a structure for coupling cavity resonators within a filter.

BACKGROUND

Radio frequency (RF) equipment uses a variety of approaches and structures for receiving and transmitting radio waves in selected frequency bands. Typically, filtering structures are used to maintain proper communication using frequencies assigned to a particular band. The type of filtering structure used often depends upon the intended use and the specifications for the radio equipment. For example, bandpass filters formed with cavity resonators are often used for filtering electromagnetic energy in certain frequency bands, such as those used for cellular and PCS communications. A bandpass filter allows only a predetermined band of frequencies to pass through a signal path.

Many cellular telephone applications require the filter to have a very low insertion loss such as 0.5 dB within a bandwidth such as 840 MHz to 870 MHz. Such a low insertion loss requires the use of cavity resonators that have a very high Q or quality factor. Q provides a figure of merit for a resonator system. However, such a filter requires relatively large cavities, which creates a relatively large distance between resonators positioned in adjacent cavities. The difficulty is that increasing the distance between adjacent resonators reduces the coupling between them and causes inefficient bandwidth.

Another problem relates to the effects of temperature on the resonate frequency of the filter and hence on the performance of the filter. As the temperature of the resonator increase or decrease, they will expand or contract accordingly, which will change the resonate frequency of the resonators. Such a change in the resonate frequency may effect the passband of the filter and the integrity of the signal being passed through the filter.

Accordingly, there is a need for a mechanism to provide an adequate amount of coupling between adjacent resonators. There is also a need for a cavity resonator that has a mechanism for improving bandwidth characteristics. There is a further need for an improved cavity resonator that filters out the 3*d* harmonic from a signal. There is yet a further need for a cavity resonator filter that compensates for the effect of temperature changes. There is a related need for a filter structure that has minimal changes in the resonate frequency due to temperature changes.

SUMMARY

One embodiment of the present invention is directed to a resonator filter. The resonator filter comprises a housing formed with a conductive material. The housing defines a first cavity, a second cavity, and an intermediate wall positioned between the first and second cavities. The housing defines an opening between the first and second cavities. First and second center conductors are positioned within the first and second cavities, respectively. A coupler is connected between the first center conductor and the housing.

An alternative embodiment of the present invention is directed to a resonator filter having a housing formed with a conductive material. The housing defines a first cavity, a second cavity, and an intermediate wall positioned between the first and second cavities. The housing defines an opening between the first and second cavities. First and second center conductors are positioned within the first and second cavities, respectively. A coupling wire is connected between the first center conductor and the housing. The coupling wire and the center conductor have substantially equal thermal expansion coefficients.

An alternative embodiment of the present invention is directed to a resonator filter having a housing formed with a conductive material. The housing defines a first cavity, a second cavity, and an intermediate wall positioned between the first and second cavities. The housing defines an opening between the first and second cavities. First and second center conductors are positioned within the first and second cavities, respectively. A coupling wire is connected between the first center conductor and the housing. At least some of the same material used to form the coupling wire being the same as at least some of the material used to form the center conductor.

DETAILED DESCRIPTION

Figure 1:
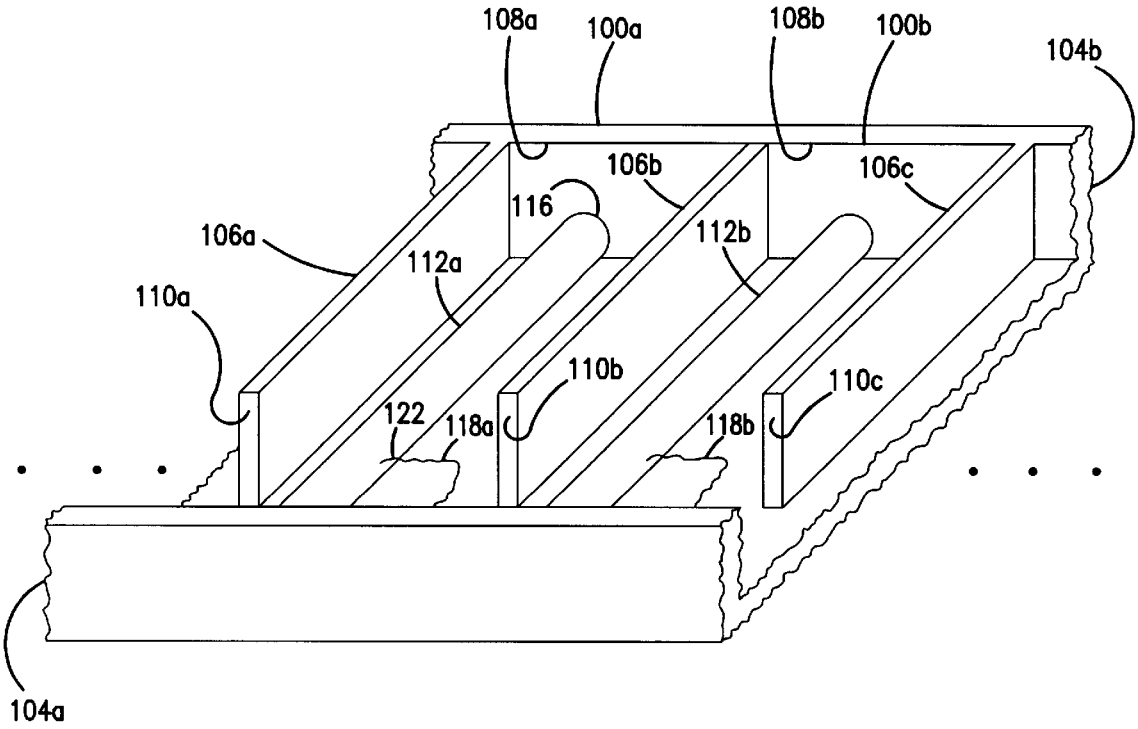
FIG. 1 is a partial perspective view of adjacent resonator cavities embodying the present invention.

The present invention initially will be described in general terms. Various embodiments of the present invention, including a preferred embodiment, then will be described in detail with reference to the drawings wherein like reference numerals represent like parts and assemblies throughout the several views. Reference to the described embodiments does not limit the scope of the invention, which is limited only by the scope of the appended claims.

In general terms, the present invention relates to the coupling of cavity resonators. Maintaining adequate coupling is important to achieve a wide passband and a low insertion loss for a filter formed from the cavity resonators having a high Q and hence a large cavity. The present invention also compensates for the effect that temperature has on the physical structure of a cavity resonator to maintain the resonate frequency at a substantially constant level.

Figure 2:
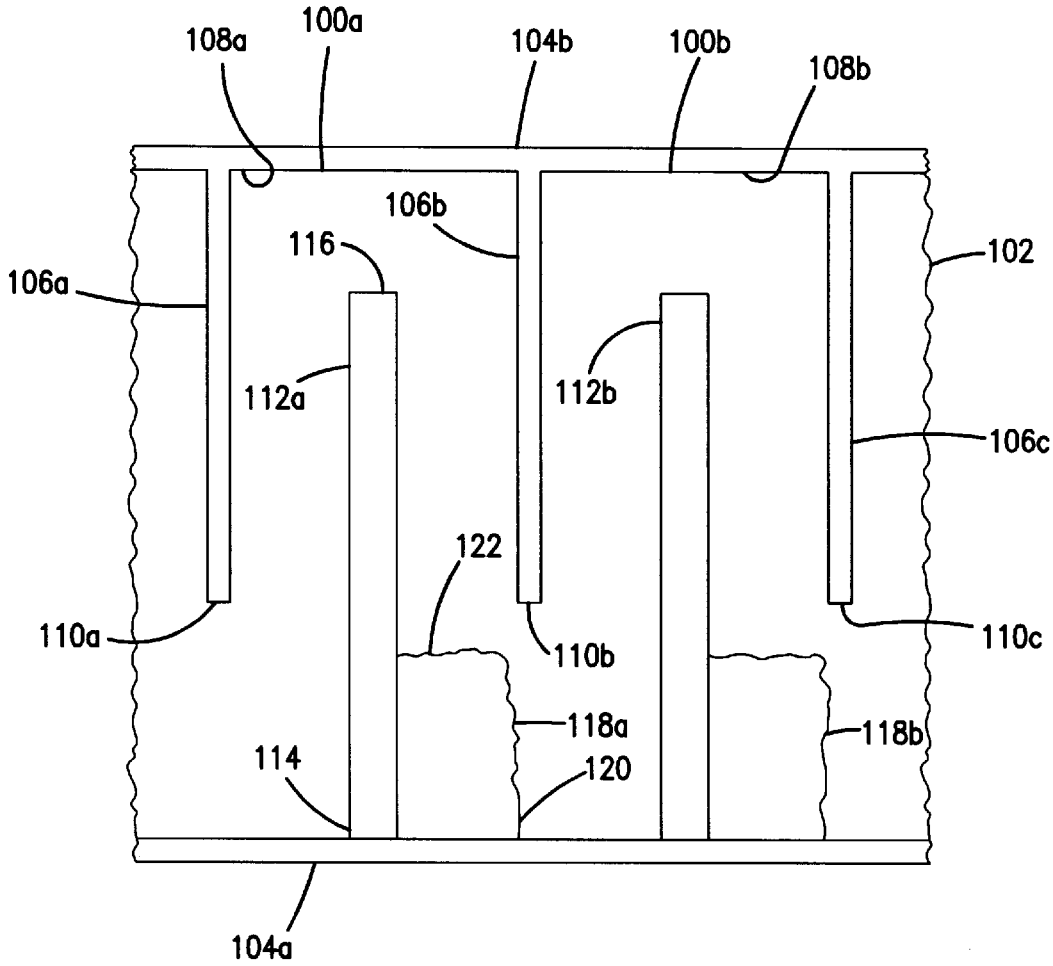
FIG. 2 is a partial top view of the resonator cavities shown in FIG. 1.

FIGS. 1 and 2 generally illustrates two adjacent cavity resonators 100*a* and 100*b* that are arranged within a set of resonators. The cavity resonators 100*a* and 100*b* are cascaded in series along an energy path to form a resonator structure that functions as a filter. Although only two cavity resonators are described below, there can be any number of cavity resonators coupled together. For example, one embodiment that provides electrical characteristics desirable for cellular telephone systems has eight cavity resonators and is known as an eight-pole filter. Typical applications for such a filter are described in more detail in United States Patent Applications Ser. No. 08/821,246, which is entitled CAVITY RESONATOR STRUCTURE HAVING IMPROVED CAVITY ARRANGEMENT and was filed on Mar. 20, 1997; Ser. No. 08/886,990, which is entitled RESONATOR STRUCTURE PROVIDING NOTCH AND BANDPASS FILTERING and was filed on Jul. 2, 1997; and Ser. No. 09/012,264, which is entitled A CIRCUIT ARRANGEMENT FOR REDUCING PASSBAND RIPPLE OF A BANDPASS FILTER and was filed on Jan. 23, 1998, the disclosures of which are hereby incorporated by reference.

The cavity resonators 100*a* and 100*b* are formed from a housing 102 that includes two end walls 104*a* and 104*b*, which are substantially parallel to one another. A plurality of intermediate walls 106*a*–106*c* are perpendicular to the end walls 104*a* and 104*b*. In this configuration, the end walls 104*a* and 104*b* and the intermediate walls 106*a* and 106*b* form a first cavity 108*a*. Similarly the end walls 104*a* and 104*b* and the intermediate walls 106*b* and 106*c* form a second, adjacent cavity 108*b*. In one possible embodiment for filters designed to operate in the 800/900 MHz range, the depth of the cavities 108*a* and 108*b* ranges from about 20 mm to about 60 mm, the width of the cavities 108*a* and 108*b* ranges from about 20 mm to about 60 mm, and the length of the cavities 108*a* and 108*b* ranges from about 70 mm to about 100 mm. Yet other embodiments may have other dimensions for the cavities 108*a* and 108*b*. For example, the length of the cavities 108*a* and 108*b* may be increased or decreased if the filter is designed to operate at other frequencies. Additionally, a cover (not shown) is positioned over the top edge of the end walls 104*a* and 104*b* and the intermediate walls 106*a*–106*c* to enclose the cavities 108*a* and 108*b*.

Although the end walls 104*a*–104*b* are shown as outer walls of the housing 102, alternative embodiments may have cavity resonators positioned end to end, or in other arrangements, so that either one or both of the end walls 104*a* or 104*b* is internal to the housing 102. For example, the end wall 104*a* may form the top of one cavity resonator and the bottom of the first cavity resonator 100*a*.

Figure 3:
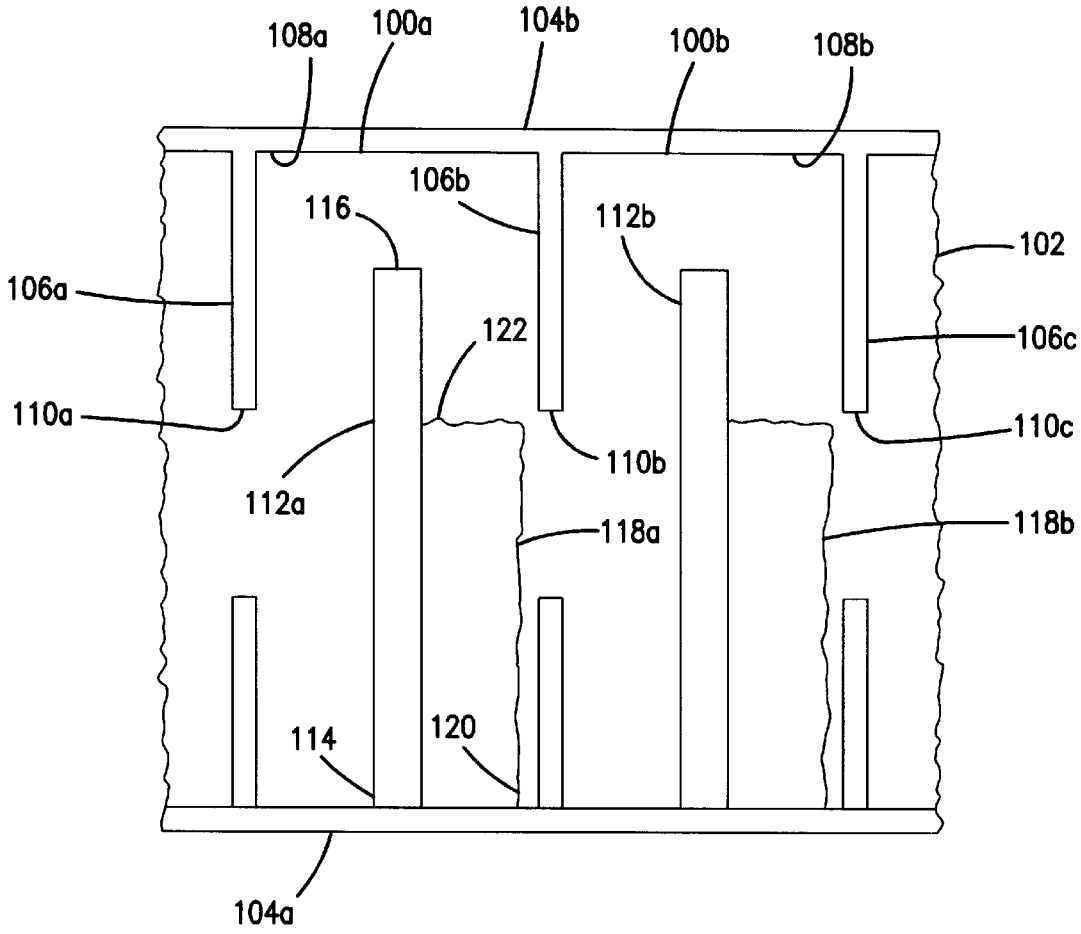
FIG. 3 is a partial top view of an alternative embodiment of the resonator cavities shown in FIGS. 1 and 2.

The housing 102 defines an opening 110*b* for passing energy from cavity 108*a* to adjacent cavity 108*b*, thereby coupling the cavity resonators 100*a* and 100*b*. The housing 102 defines an opening 110*a* similar to the opening 110*b*, which permits energy to be passed from an upstream cavity to the cavity 108*a*. The housing 102 defines an opening 110*c* through which energy can pass from the cavity 108*b* to a downstream cavity. In one possible embodiment, as shown in FIGS. 1 and 2, the openings 100*a*–100*c* defined between the end of the intermediate walls 106*a*–106*c*, respectively, and the end wall 104*a*. In alternative embodiments, as shown in FIG. 3, the openings 100*a*–110*c* are defined between the first and second ends of the intermediate walls 106*a*–106*c*.

A post or center conductor 112*a* is positioned within the cavity 108*a*. The post 112*a* has first and second ends 114 and 116. The first end 114 is connected to the end wall 104*a*. In one possible embodiment for filters designed to operate in the 800/900 MHz range, the length of the post 112*a* ranges from about 65 mm to about 90 mm, and the diameter of the post 112*a* ranges from about 8 mm to about 16 mm. Again, the post 112*a* may have different dimensions in other embodiments and in filters designed to operate at different frequencies. A post 112*b* is substantially similar to post 112*a* and is positioned within the cavity 108*b*.

A first coupler in the form of a coupling wire 118*a* has a first end 120 connected to the end wall 104*a* and a second end 122 connected to the post 112*a*. In one possible embodiment, the second end 122 is connected to the post 112*a* at a point about one third of the distance from the first end 114 of the post 112*a* to the second end 116 of the post 112*a*. The coupling wire 118*a* is generally arranged so that it is proximal to and opposes the opening 110*b*. In one possible embodiment, for example, the coupling wire 118*a* is shaped so that it extends upward from the end wall 104*a* across the opening 110*b* and then is bent about 90° toward the post 112*a*. In other embodiments, the coupling wire 118*a* is bent at other angles or is generally curved.

In one possible embodiment for filters designed to operate in the 800/900 MHz range, the length of the coupling wire 118*a* ranges from about 40 mm to about 70 mm. The coupling wire 118*a* may have different lengths in other embodiments and in filters designed to operate at different frequencies. A second coupler in the form of a coupling wire 118*b* is similarly connected between the post 112*b* and the end wall 104*a*.

In use, the filter is tuned to meet the desired bandwidth characteristics by connecting it to a network analyzer. A signal is then passed through the filter. The coupling wires 118*a* and 118*b* are then shaped or bent to adjust the coupling between the cavity resonators 100*a* and 100*b* until the desired bandwidth is achieved.

Although the coupling wire 118*a* is shown extending from the center post 112*a* toward the downstream cavity resonator 100*b*, an alternative embodiment has the coupling wire positioned toward the opening toward the upstream cavity. In this embodiment, for example, the coupling wire 118*a* in the first cavity resonator 100*a* opposes the opening 110*a*, and the coupling wire 118*b* in the second cavity resonator 100*b* opposes the opening 110*b*. In yet other possible embodiments, each cavity resonator was two coupling wires, one opposing the opening to the upstream cavity and one opposing the opening to the downstream cavity.

The distance, $L_1$, between the first end 120 of the coupling wire 118*a* and the post 112*a* is experimentally determined according to the filter's passband bandwidth requirement. The distance, d, between the second end 122 of the coupling wire 118*a* and the end wall 104*a* is approximately determined according to the equation $d=\lambda_0/12$. This distance provides improved filtering of a signal's 3*d* harmonic. $\lambda_0$ is the operating wavelength of the center frequency in the passband. The length, L, of the coupling wire 118*a* is determined according to the equation $L=L_1+\lambda_0$.

In use, current conducted along the coupling wire 118*a* generates a magnetic field that passes through the opening 110*b*. The resulting magnetic energy that passes through the opening 110*b* is greater than the energy that would otherwise pass through if there was no coupling element in place. As a result, the coupling wire 118*a* increases the magnetic coupling between adjacent cavity resonators 100*a* and 100*b*. In one possible embodiment, various components of the filter are formed with electrically conductive materials having compatible thermal expansion coefficients so that their expansion or contraction will cause minimal frequency shift of a signal passing through the filter. The compatibility of materials is experimentally determined by passing the resonator's resonate frequency through the filter, heating the filter, and measuring the frequency shift of the signal when the filter is at the elevated temperature. In one possible embodiment, the housing 102 is formed with aluminum, the post 112*a* is formed with steel, and the coupling wire 118*a* is formed with copper. Other conductive materials can be used to form the filter. For example, other embodiments use materials such as brass for the housing 102, aluminum for the post 112*a*, or aluminum for the coupling wire 118*a*.

Maintaining a ratio of expansion and contraction between the housing 102, the center post 112*a*, and the coupling wire 118*a* compensates for the effect of temperature on the resonate frequency of the cavity resonator 100*a*. Without temperature compensation, for example, both the Q and the resonate frequency decreases as the post 112*a* expands under increasing temperatures. As a result, the insertion loss increases, which adversely affects the performance of the filter. Expansion of the housing 102 compensates for the increased length of the post 112*a* and hence reduces the resulting shift in the resonate frequency. Similarly, the resonate frequency increases as the diameter expands for that portion of the post 112*a* between the end wall 104*a* of the housing 102 and the second end 122 of the coupling wire 118*a*. Expansion of the coupling wire 118*a* offsets or reduces this the resulting shift in the resonate frequency.

While the invention has been described in conjunction with a specific embodiments thereof, it is evident that other alternatives, modifications, and variations can be made in view of the foregoing description. For example, features of one of the embodiments described above can be combined with features of any of the other embodiments. Alternatively, there can be modifications that are not explicitly taught herein, but still embody the spirit of invention claimed below. Accordingly, the invention is not limited to these embodiments or the use of elements having specific configurations and shapes as presented herein.

The claimed invention is:

1. A resonator filter comprising:

a housing formed with a conductive material, the housing defining a first cavity, a second cavity, and an intermediate wall positioned between the first and second cavities, the housing defining an opening between the first and second cavities;

first and second center conductors positioned within the first and second cavities, respectively; and a coupler connected between the first center conductor and the housing, the coupler being formed from a coupling wire and arranged to couple the first and second center conductors.

2. The resonator filter of claim 1 wherein the coupling wire has a first end connected to the first center conductor and a second end connected to the housing.

3. The resonator filter of claim 1 wherein the wire has a first portion approximately parallel to the intermediate wall and a second portion approximately perpendicular to the center conductor, the first portion opposing the opening.

4. The resonator filter of claim 1 wherein the coupling wire is bendable.

5. The resonator filter of claim 1 wherein:

the first cavity is further formed with an end wall;

the first center conductor having one end connected to the end wall; and the coupling wire has a first end connected to the first center conductor and a second end connected to the end wall.

6. The resonator filter of claim 1 wherein the first center conductor has first and second ends, the second end is connected to the end wall, and the coupling wire is connected to the first center conductor at a point about one third of the distance from the first end of the first center conductor to the second end of the first center conductor.

7. The resonator filter of claim 1 wherein the opening in the housing is defined between the intermediate wall and the first end wall.

8. The resonator filter of claim 1 wherein the opening in the housing is defined between the first and second ends of the intermediate wall.

9. The resonator filter of claim 1 wherein the first center conductor is a post.

10. The resonator filter of claim 1 wherein the first center conductor and the coupling wire are formed using the same material.

11. The resonator filter of claim 1 wherein the center conductor and the coupling wire are formed using aluminum.

12. The resonator filter of claim 1 wherein the center conductor is formed with steel, the coupling wire is formed with copper, and the housing is formed with aluminum.

13. A resonator filter comprising:

a housing formed with a conductive material, the housing defining a first cavity, a second cavity, and an intermediate wall positioned between the first and second cavities, the housing defining an opening between the first and second cavities;

first and second center conductors positioned within the first and second cavities, respectively; and a coupler connected between the first center conductor and the housing, the coupler being formed from a bendable coupling wire and arranged to couple the first and second center conductors.

* * * * *